US010933553B2

(12) United States Patent
Fukushima et al.

(10) Patent No.: US 10,933,553 B2
(45) Date of Patent: Mar. 2, 2021

(54) THREE SIDE TRIMMER

(71) Applicant: Horizon International Inc., Takashima (JP)

(72) Inventors: Kazuyuki Fukushima, Takashima (JP); Yoshinari Kuwabara, Takashima (JP); Tatsuaki Ida, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 46 days.

(21) Appl. No.: 16/437,302

(22) Filed: Jun. 11, 2019

(65) Prior Publication Data

US 2020/0047367 A1 Feb. 13, 2020

(30) Foreign Application Priority Data

Aug. 8, 2018 (JP) ..... JP2018-149622

(51) Int. Cl.
*B26D 7/32* (2006.01)
*B26D 7/00* (2006.01)
*B42C 3/00* (2006.01)

(52) U.S. Cl.
CPC ..... *B26D 7/32* (2013.01); *B26D 2007/0081* (2013.01); *B42C 3/00* (2013.01)

(58) Field of Classification Search
CPC .... B26D 7/32; B26D 2007/0081; B26D 7/27; B26D 5/00; B65H 31/04; B65H 31/08; B65H 31/10; B65H 31/3054; B65H 31/30; B42C 3/00
USPC ..... 414/789.7, 789.9, 790.6, 793.8, 794.4
See application file for complete search history.

(56) References Cited

U.S. PATENT DOCUMENTS 2,901,952 A * 9/1959 Taylor ..... B65H 31/28 414/788.9
3,379,320 A * 4/1968 Loach ..... B65H 33/08 414/788.3
3,510,123 A 5/1970 Thumim et al.
4,030,621 A * 6/1977 Swanson ..... B65H 33/08 414/788.3
4,065,117 A * 12/1977 Thorsheim ..... B65H 31/3054 270/52.02

(Continued)

FOREIGN PATENT DOCUMENTS

EP 0 740 983 A1 11/1996
EP 1 733 855 A1 12/2006

(Continued)

OTHER PUBLICATIONS

Extended Search Report dated Dec. 12, 2019, issued in counterpart EP Application No. 19189962.4 (9 pages).

*Primary Examiner* — Patrick H Mackey
(74) *Attorney, Agent, or Firm* — Westerman, Hattori, Daniels & Adrian, LLP

(57) ABSTRACT

A three side trimmer has a trimming unit 1, an accumulating unit 3, a discharge unit 2 and a conveying mechanism 4 conveying trimmed booklets BK to the accumulating unit. The accumulating unit has a shelf 5 movable in a vertical direction, and a drive roller conveyor 7 on the shelf. The accumulating unit, in a mode, delivers the trimmed booklets to the discharge unit at every accumulation of a predetermined number of the trimmed booklets and, in another mode, accumulates the trimmed booklets without delivering.

7 Claims, 3 Drawing Sheets

(56) References Cited

U.S. PATENT DOCUMENTS

| | | | | | |
|---|---|---|---|---|---|
| 4,765,790 | A * | 8/1988 | Besemann | B65H 31/10 | 414/790.4 |
| 4,926,220 | A * | 5/1990 | Matysek | B65H 31/24 | 399/404 |
| 5,002,456 | A * | 3/1991 | Gosslinghoff | B65H 31/3081 | 414/788.3 |
| 5,014,974 | A * | 5/1991 | Jones | B65H 29/66 | 271/189 |
| 6,527,501 | B2 * | 3/2003 | Wolf | B65H 29/66 | 271/217 |
| 6,695,302 | B1 * | 2/2004 | Lamothe | B65H 29/18 | 271/214 |
| 9,394,133 | B2 * | 7/2016 | Knoefel | B65H 31/10 | |
| 10,287,113 | B2 * | 5/2019 | Adami | B65G 57/035 | |
| 2005/0269765 | A1 * | 12/2005 | Widmer | B65H 31/10 | 271/190 |

FOREIGN PATENT DOCUMENTS

| | | | |
|---|---|---|---|
| EP | 1 752 406 | A1 | 2/2007 |
| JP | 64-17758 | A | 1/1989 |
| JP | 2013-18084 | A | 1/2013 |
| JP | 2013-230539 | A | 11/2013 |

* cited by examiner

THREE SIDE TRIMMER

TECHNICAL FIELD

The present invention relates to a three side trimmer.

BACKGROUND ART

In some conventional three side trimmers, each time three sides (head, foot and front) of one or more booklets are trimmed by the three side trimmer, the trimmed booklets are delivered to a discharge device (a conveyor belt etc.) which is arranged at an exit of the three side trimmer and discharged to the outside by the discharge device (for example, see JP 2013-230539 A).

Alternatively, in some conventional three side trimmers, each time three sides (head, foot and front) of one or more booklets are trimmed by the three side trimmer, the trimmed booklets are accumulated in a stacker which is arranged at an exit of the three side trimmer. Then, when the stacker is filled with the trimmed booklets, the accumulated booklets are took out together in the form of a single stack by hand (for example, see JP 2013-18084 A).

On the other hand, in a booklet manufacturing site, in order to process various orders efficiently, in some cases, it is preferable to sequentially discharge trimmed booklets whenever the trimming operation is completed, on the other hand, in some cases, it is preferable to discharge trimmed booklets together in the form of a single stack.

However, there is no three side trimmer adapted to switch the two different kinds of discharging methods in the prior art.

Also, no matter whether the trimmed booklets are sequentially discharged by the discharge device or the trimmed booklets are discharged together in the form of the single stack by hand, the trimmed booklets discharged from the three side trimmer are packed as final products in a succeeding process.

In this case, the packing is performed for each required number of the trimmed booklets, and the number of the trimmed booklets to be packed can be changed generally.

Therefore, according to the above-mentioned conventional three side trimmers, it is necessary to gather the trimmed booklets for each required number of the trimmed booklets or to divide the stack of trimmed booklets into every required number of the trimmed booklets.

However, the gathering and dividing work is performed by hand, which contributes to the lowering of work efficiency.

SUMMARY OF THE INVENTION

Problems to be Solved by the Invention

It is, therefore, an object of the present invention to provide a three side trimmer operative to switch a first mode in which the three side trimmer discharges the trimmed booklets at every accumulation of a required number of the trimmed booklets and a second mode in which the three side trimmer accumulates the trimmed booklets so as to gather the trimmed booklets into a single stack.

Means for Solving the Problems

In order to achieve this object, the present invention provides a three side trimmer comprising: a trimming unit trimming three sides of one or more booklets; a discharge unit arranged downstream of the trimming unit to discharge the trimmed booklets, an entrance of the discharge unit being arranged at a height equal to or lower than an exit of the trimming unit; an accumulating unit arranged between the trimming unit and the discharge unit and operative to switch between a delivery mode in which the accumulating unit delivers the trimmed booklets to the discharge unit at every accumulation of a predetermined number of the trimmed booklets and an accumulation mode in which the accumulating unit accumulates the trimmed booklets without delivering the trimmed booklets to the discharge unit; and a conveying mechanism conveying the trimmed booklets from the trimming unit to the accumulating unit each time the trimming operation is completed, wherein the accumulating unit has a shelf movable in a vertical direction, the trimmed booklets being placed on the shelf, an elevating mechanism moving the shelf up and down, and a conveyor belt or a drive roller conveyor arranged on the shelf and adapted to supply the trimmed booklets placed on the shelf to an entrance of the discharge unit, wherein during operation of the accumulating unit in the delivery mode, the shelf of the accumulating unit is lowered from a height equal to the exit of the trimming unit by a distance corresponding to a thickness of the trimmed booklets at every placement of the trimmed booklets on the shelf, and when the predetermined number of the trimmed booklets are accumulated on the shelf, the shelf is moved to a height equal to the entrance of the discharge unit and stopped in a manner such that the conveyor belt or the drive roller conveyor supplies the predetermined number of the trimmed booklets to the discharge unit, thereafter the shelf is moved to the height equal to the exit of the trimming unit so as to receive the next trimmed booklets, and during operation of the accumulating unit in the accumulation mode, the shelf of the accumulating unit is lowered from the height equal to the exit of the trimming unit by a distance corresponding to the thickness of the trimmed booklets at every placement of the trimmed booklets on the shelf until the number of the trimmed booklets accumulated on the shelf reaches the maximum number of the trimmed booklets that can be accommodated by the accumulating unit or a predetermined numerical value.

According to a preferred embodiment of the present invention, the conveying mechanism has a chuck head gripping the trimmed booklets, a guide extending from the trimming unit to the shelf of the accumulating unit, the chuck head being slidably mounted on the guide, and a chuck head drive mechanism reciprocating the chuck head along the guide, wherein whenever the trimming operation is completed, the chuck head moves from the trimming unit to the accumulating unit while gripping the trimmed booklets, and releases the trimmed booklets at a position above the shelf so as to place the trimmed booklets on the shelf, thereafter moves toward the trimming unit to grip the next trimmed booklets.

According to another preferred embodiment of the present invention, a photoelectric sensor is arranged at the exit of the trimming unit to detect the trimmed booklets placed on the shelf of the accumulating unit, the photoelectric sensor being in an ON-state when a light beam horizontally irradiated from the photoelectric sensor is intercepted by the trimmed booklets, and being in an OFF-state when the light beam is not intercepted, wherein the shelf starts lowering when the chuck head releases the trimmed booklets, and stops when the photoelectric sensor switches into the OFF-state, so that the shelf lowers by the distance corresponding to the thickness of the trimmed booklets at every placement of the trimmed booklets on the shelf.

According to further preferred embodiment of the present invention, a proximity sensor is arranged at one of the discharge unit or the trimming unit and the shelf of the accumulating unit, and a plate to be detected by the proximity sensor is arranged at the other of the discharge unit or the trimming unit and the shelf, the proximity sensor detecting the plate when the shelf reaches the height of the entrance of the discharge unit, wherein during operation of the accumulating unit in the delivery mode, whenever the shelf having the predetermined number of the trimmed booklets thereon is raised or lowered and the plate is detected by the proximity sensor, the shelf is stopped in a manner such that the conveyor belt or the drive roller conveyor on the shelf supplies the predetermined number of the trimmed booklets to the discharge unit.

According to further preferred embodiment of the present invention, the conveyor belt or the drive roller conveyor on the shelf repeats forward and backward motions alternately by a certain distance at every accumulation of a certain number of the trimmed booklets on the shelf until the predetermined number of the trimmed booklets are accumulated on the shelf, whereby the trimmed booklets are placed at positions alternately shifted on the shelf.

According to further preferred embodiment of the present invention, the height of the entrance of the discharge unit can be changed.

According to further preferred embodiment of the present invention, the discharge unit is a conveyor belt or a drive roller conveyor or a free roller conveyor.

Effect of the Invention

According to the present invention, the accumulating unit is arranged between the trimming unit and the discharge unit, and the accumulating unit operative to switch between the delivery mode in which the accumulating unit delivers the trimmed booklets to the discharge unit at every accumulation of a predetermined number of the trimmed booklets and the accumulation mode in which the accumulating unit accumulates the trimmed booklets without delivering the trimmed booklets to the discharge unit. Therefore, in a single three side trimmer, it is possible to cope with both a case in which it is preferable to sequentially discharge trimmed booklets each time the trimming operation is completed and a case in which it is preferable to discharge trimmed booklets together in the form of a single stack, thereby various orders can be processed efficiently.

Furthermore, the efficiency of the booklet packing work ups greatly because of discharging the trimmed booklets from the three side trimmer while gathering the trimmed booklets for each required number of the trimmed booklets.

BEST MODE FOR CARRYING OUT THE INVENTION

A preferred embodiment of the present invention will be explained below with reference to accompanying drawings.

Figure 1:
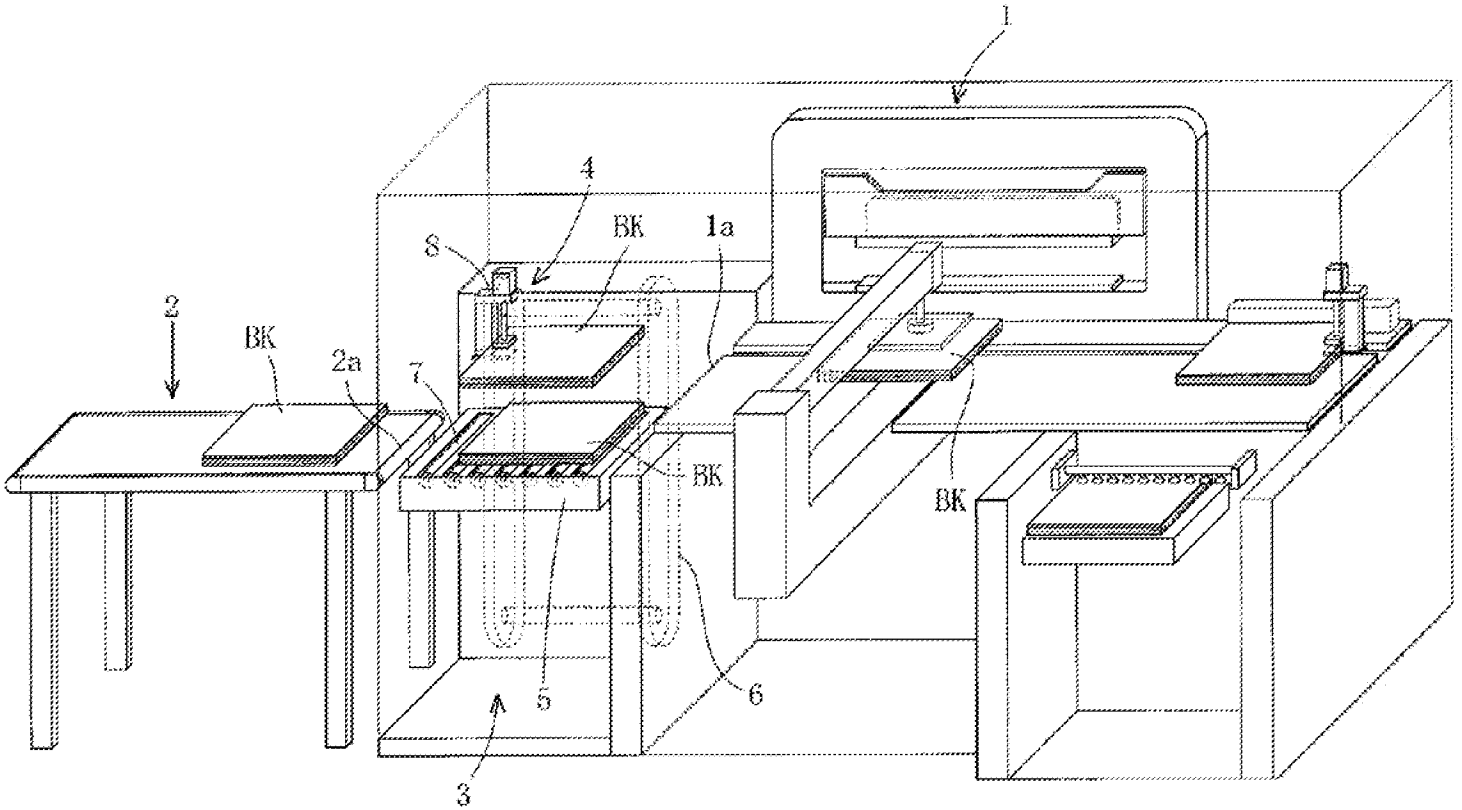
FIG. 1 is a perspective view illustrating a configuration of a whole of a three side trimmer according to an embodiment of the present invention.

FIG. 1 is a perspective view illustrating a configuration of a whole of a three side trimmer according to an embodiment of the present invention.

Referring to FIG. 1, the three side trimmer of the present invention comprises a trimming unit 1 trimming three sides (head, foot and front) of one or more booklets BK, and a discharge unit 2 arranged downstream of the trimming unit to discharge the trimmed booklets BK.

In the three side trimmer 1, one booklet BK or a set of booklets BK is processed at one trimming operation. The number of the booklets BK to be processed per one trimming operation is preset based on the information inputted through a control panel (not shown) of the three side trimmer.

In this embodiment, the trimming unit trims the booklets BK one by one.

The discharge unit 2 is a conveyor belt or a drive roller conveyor or a free roller conveyor. An entrance 2*a* of the discharge unit 2 is arranged at a height lower than an exit 1*a* of the trimming unit 1.

In this case, the entrance 2*a* of the discharge unit 2 may be arranged at a height equal to the exit 1*a* of the trimming unit 1.

The three side trimmer of the present invention further comprises an accumulating unit 3 operative to switch between a delivery mode in which the accumulating unit 3 delivers the trimmed booklets BK to the discharge unit 2 at every accumulation of a predetermined number of the trimmed booklets BK and an accumulation mode in which the accumulating unit 3 accumulates the trimmed booklet BK without delivering the trimmed booklet BK to the discharge unit 2, and a conveying mechanism 4 conveying the trimmed booklet BK from the trimming unit 1 to the accumulating unit 3 each time the trimming operation is completed.

The accumulating unit 3 has a shelf 5 movable in a vertical direction. The trimmed booklet BK is placed on the shelf 5.

The accumulating unit 3 also has an elevating mechanism 6 moving the shelf 5 up and down, and a drive roller conveyor 7 arranged on the shelf 5 and adapted to supply the trimmed booklets BK placed on the shelf 5 to the entrance 2*a* of the discharge unit 2.

In this case, a conveyor belt may be used instead of the drive roller conveyor 7, and the elevating mechanism 6 is composed of a well-known appropriate mechanism for moving the shelf 5 up and down.

The conveying mechanism 4 has, in this embodiment, a chuck head 8 gripping the trimmed booklet BK, and a guide 4*a* extending from the trimming unit 1 to the shelf 5 of the accumulating unit 3. The chuck head 8 is slidably mounted on the guide.

The conveying mechanism 4 also has a chuck head drive mechanism 4*b* reciprocating the chuck head 8 along the guide.

Thus whenever the trimming operation is completed, the chuck head 8 moves from the trimming unit 1 to the accumulating unit 3 while gripping the trimmed booklet BK, and releases the trimmed booklet BK at a position above the shelf 5 so as to place the trimmed booklet BK on the shelf 5, thereafter moves toward the trimming unit 1 to grip the next trimmed booklet BK.

Thereby the conveyance of the trimmed booklet BK from the trimming unit 1 to the accumulating unit 3 is performed.

Figure 2:
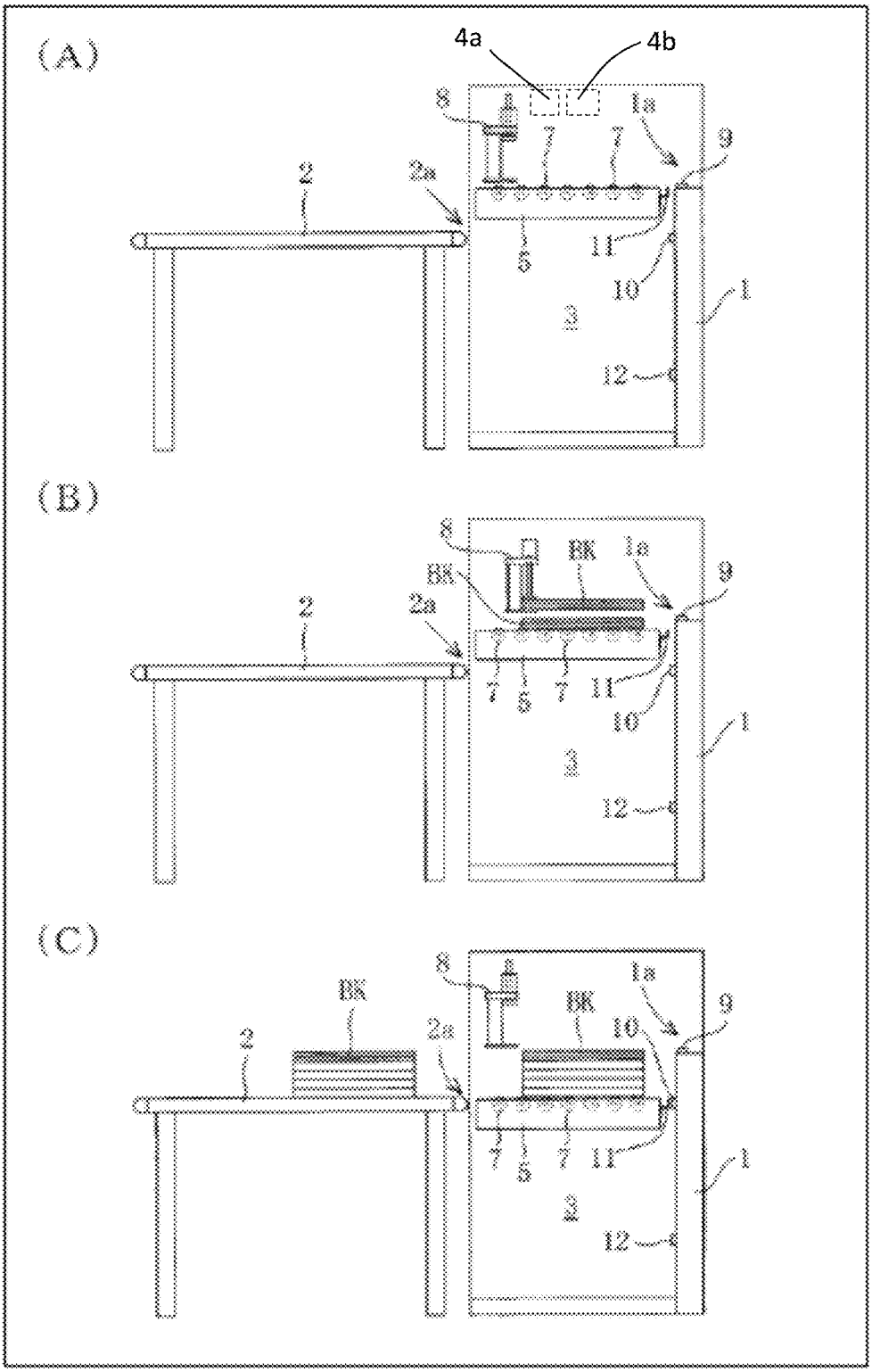
FIG. 2 is a front view illustrating an operation of the three side trimmer shown in FIG. 1, in which the three side trimmer operates in a delivery mode.
Figure 3:
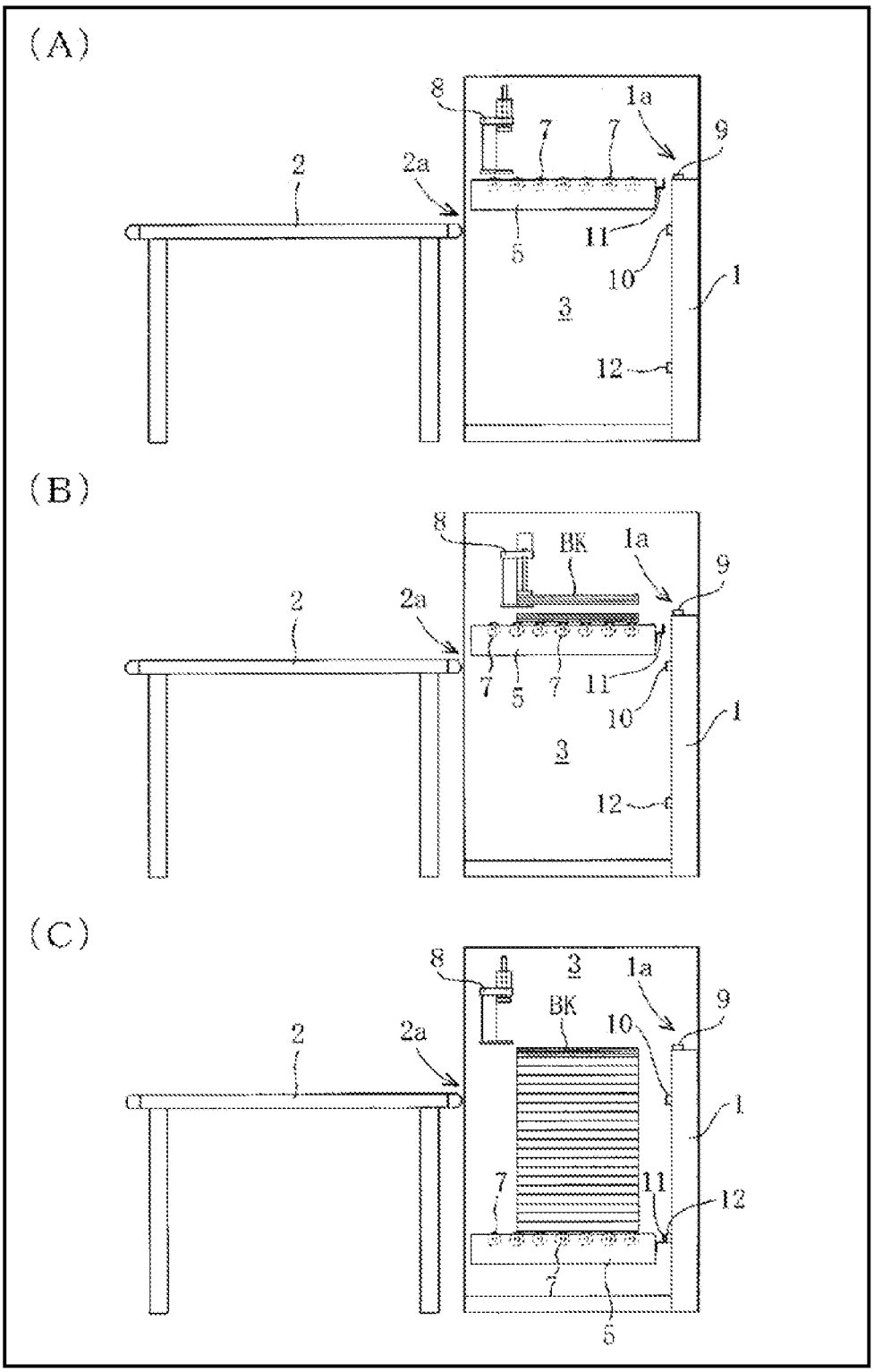
FIG. 3 is a front view illustrating an operation of the three side trimmer shown in FIG. 1, in which the three side trimmer operates in an accumulation mode.

FIG. 2 is a front view illustrating an operation of the three side trimmer shown in FIG. 1, in which the three side trimmer operates in the delivery mode. FIG. 3 is a front view illustrating an operation of the three side trimmer shown in FIG. 1, in which the three side trimmer operates in the accumulation mode.

Referring to FIGS. 2 and 3, a photoelectric sensor 9 is arranged at the exit 1*a* of the trimming unit 1 so as to detect the trimmed booklet BK placed on the shelf 5 of the accumulating unit 3.

The photoelectric sensor 9 is preset in such a manner such that the photoelectric sensor 9 is in an ON-state when a light beam horizontally irradiated from the photoelectric sensor 9 is intercepted by the trimmed booklet BK, and is in an OFF-state when the light beam is not intercepted.

The shelf 5 of the accumulating unit 3 is arranged at a height equal to the exit 1*a* of the trimming unit 1 when no booklet BK is accumulated on the shelf 5. Then the shelf 5 starts lowering when the chuck head 8 releases the trimmed booklet BK and stops when the photoelectric sensor 9 switches into the OFF-state. Thus the shelf 5 lowers by a distance corresponding to a thickness of the trimmed booklet BK at every placement of the trimmed booklet BK on the shelf 5 (see FIGS. 2(A) and 2(B)).

A proximity sensor 10 is arranged at one of the trimming unit 1 and the shelf 5 of the accumulating unit 3 (in this embodiment, the trimming unit 1), and a plate 11 to be detected by the proximity sensor 10 is arranged at the other of the trimming unit 1 and the shelf 5 (in this embodiment, the shelf 5).

The proximity sensor 10 detects the plate 11 when the shelf 5 reaches a height of the entrance 2*a* of the discharge unit 2 (see FIG. 2(C)).

Furthermore, another proximity sensor 12 is arranged below the proximity sensor 10 of the trimming unit 1.

This proximity sensor 12 detects the plate 11 when the number of the trimmed booklets BK accumulated on the shelf 5 reaches the maximum number of the trimmed booklets BK that can be accommodated by the accumulating unit 3 (see FIG. 3(C)).

Although the proximity sensors 10, 12 and the plate 11 are arranged at the trimming unit 1 and the shelf 5 in this embodiment, the proximity sensors 10, 12 and the plate 11 may be arranged at the discharge unit 2 and the shelf 5.

Thus, as shown in FIGS. 2(A) and 2(B), during operation of the accumulating unit 3 in the delivery mode, the shelf 5 of the accumulating unit 3 is lowered from the height equal to the exit 1*a* of the trimming unit 1 by the distance corresponding to the thickness of the trimmed booklet BK at every placement of the trimmed booklet BK on the shelf 5, and when the predetermined number of the trimmed booklets BK are accumulated on the shelf 5, the shelf 5 is moved to a height equal to the entrance 2*a* of the discharge unit 2.

Thereafter, as shown in FIG. 2(C), the shelf 5 is stopped when the proximity sensor 10 detects the plate 11. At this time the shelf 5 is arranged at the height equal to the entrance 2*a* of the discharge unit 2.

Next the drive roller conveyor 7 supplies the trimmed booklets BK accumulated on the shelf 5 to the discharge unit, thereafter the shelf 5 is moved to the height equal to the exit 1*a* of the trimming unit 1 so as to receive the next trimmed booklets BK. A set of trimmed booklets BK delivered to the discharge unit 2 is discharged to the outside by the discharge unit 2.

In this case, the number of the trimmed booklets BK to be accumulated on the shelf 5 in the delivery mode is inputted through the control panel (not shown) of the three side trimmer. On the other hand, the number of the accumulated booklets BK is counted each time the photoelectric sensor 9 switches the ON-state and the OFF-state (at every lowering of the shelf 5), and it is determined that the predetermined number of the trimmed booklets BK are accumulated on the shelf 5 when the count value equals to the inputted value.

It is also preset in the following manner whether the shelf 5 is raised or lowered for delivery of the trimmed booklets to the discharge unit 2 at accumulation of the predetermined number of the trimmed booklets BK on the shelf.

That is to say, a height of the shelf 5 at accumulation of the predetermined number of the trimmed booklets BK is calculated based on the height of the exit 1*a* of the trimming unit 1, the thickness per one booklet BK and the number of the trimmed booklets BK to be accumulated, here the thickness per one booklet BK and the number of the trimmed booklets BK to be accumulated are inputted beforehand through the control panel. Then, when the value obtained by the calculation is higher than the height of the entrance 2*a* of the discharge unit 2, the shelf 5 is set to move down, while the shelf 5 is set to move up when the value is lower than the height of the entrance 2*a*.

During operation of the accumulating unit 3 in the accumulation mode, as shown in FIGS. 3(A) and 3(B), the shelf 5 of the accumulating unit 3 is lowered from the height equal to the exit 1*a* of the trimming unit 1 by the distance corresponding to the thickness of the trimmed booklet BK at every placement of the trimmed booklet BK on the shelf 5, and as shown in FIG. 3(C), the three side trimmer stops when the proximity sensor 12 detects the plate 11. Then a stack of the trimmed booklets BK on the shelf 5 is discharged to the outside by hand.

In this embodiment, the trimmed booklets BK are accumulated in the accumulation mode until the accumulating unit 3 is filled with the trimmed booklets BK, but, according to another embodiment, the number of the trimmed booklets to be accumulated in the accumulating unit is preset through the control panel and the three side trimmer stops when the predetermined number of the trimmed booklets BK are accumulated in the accumulating unit 3 (on the shelf 5) before the accumulating unit 3 is filled with the trimmed booklets BK.

According to the present invention, the accumulating unit is arranged between the trimming unit and the discharge unit, and the accumulating unit operative to switch between the delivery mode in which the accumulating unit delivers the trimmed booklets to the discharge unit at every accumulation of a predetermined number of the trimmed booklets and the accumulation mode in which the accumulating unit accumulates the trimmed booklets without delivering the trimmed booklets to the discharge unit. Therefore, in a single three side trimmer, it is possible to cope with both a case in which it is preferable to sequentially discharge trimmed booklets each time the trimming operation is completed and a case in which it is preferable to discharge trimmed booklets together in the form of a single stack, thereby various orders can be processed efficiently.

In addition, the efficiency of the booklet packing work ups greatly because of discharging the trimmed booklets from the three side trimmer while gathering the trimmed booklets for each required number of the trimmed booklets.

While a preferred embodiment of the present invention has been set forth for purposes of illustration, the foregoing description should not be deemed a limitation of the invention herein. Accordingly, various modifications, adaptations and alternatives may occur to one skilled in the art without departing from the spirit and the scope of the present invention.

For example, in the above-mentioned embodiment, no matter whether the accumulating unit operates in the delivery mode or the accumulation mode, the shelf is lowered by the distance corresponding to the thickness of the trimmed booklet at every placement of the trimmed booklet on the shelf until the predetermined number of the trimmed booklets are accumulated on the shelf, but, according to another embodiment, not only the shelf is lowered by the distance corresponding to the thickness of the trimmed booklet at every placement of the trimmed booklet on the shelf, but also the drive roller conveyor on the shelf repeats forward and backward motions alternately by a certain distance at every accumulation of a certain number of the booklets on the shelf. Thereby, the trimmed booklets are placed at positions alternately shifted on the shelf so that the efficiency of a trimmed booklet sorting work is improved.

Although the entrance of the discharge unit is fixed at a predetermined height in the above-mentioned embodiment, the height of the entrance of the discharge unit may be changed.

Although the chuck head is used as the conveying mechanism conveying the trimmed booklet from the trimming unit to the accumulating unit in the above-mentioned embodiment, a configuration of the conveying mechanism is not limited to the above-mentioned embodiment, and for example, a pusher and so on may be used as the conveying mechanism.

Although an operation of elevating the shelf of the accumulating unit is controlled by using the sensors (the photoelectric sensor and proximity sensors) in the above-mentioned embodiment, the control of the elevating operation may be performed by using a rotary encoder or a potentiometer which is attached to the elevating mechanism.

Moreover, although the discharge unit is connected to the accumulating unit in such a way that a direction of discharging of the discharge unit aligns with a direction of conveying of the conveying mechanism in the above-mentioned embodiment, the discharge unit may be connected to the accumulating unit in such a way that the direction of discharging of the discharge unit is perpendicular to the direction of conveying of the conveying mechanism.

In this case, just like the discharge unit, the drive roller conveyor (or the conveyor belt) on the shelf of the accumulating unit is also arranged perpendicular to the direction of conveying of the conveying mechanism.

DESCRIPTION OF REFERENCE NUMERALS

1 Trimming unit
1*a* Exit
2 Discharge unit
2*a* Entrance
3 Accumulating unit
4 Conveying mechanism
5 Shelf
6 Elevating mechanism
7 Drive roller conveyor
8 Chuck head
9 Photoelectric sensor
10 Proximity sensor
11 Plate to be detected (by proximity sensor)
12 Another proximity sensor
BK Booklet

The invention claimed is:

1. A three side trimmer comprising:

a trimming unit trimming three sides of one or more booklets;

a discharge unit arranged downstream of the trimming unit to discharge the trimmed booklets, an entrance of the discharge unit being arranged at a height equal to or lower than an exit of the trimming unit;

an accumulating unit arranged between the trimming unit and the discharge unit and operative to switch between a delivery mode in which the accumulating unit delivers the trimmed booklets to the discharge unit at every accumulation of a predetermined number of the trimmed booklets and an accumulation mode in which the accumulating unit accumulates the trimmed booklets without delivering the trimmed booklets to the discharge unit; and a conveying mechanism conveying the trimmed booklets from the trimming unit to the accumulating unit each time the trimming operation is completed, wherein the accumulating unit has a shelf movable in a vertical direction, the trimmed booklets being placed on the shelf, an elevating mechanism moving the shelf up and down, and a conveyor belt or a drive roller conveyor arranged on the shelf and adapted to supply the trimmed booklets placed on the shelf to an entrance of the discharge unit, wherein during operation of the accumulating unit in the delivery mode, the shelf of the accumulating unit is lowered from a height equal to the exit of the trimming unit by a distance corresponding to a thickness of the trimmed booklets at every placement of the trimmed booklets on the shelf, and when the predetermined number of the trimmed booklets are accumulated on the shelf, the shelf is moved to a height equal to the entrance of the discharge unit and stopped in a manner such that the conveyor belt or the drive roller conveyor supplies the predetermined number of the trimmed booklets to the discharge unit, thereafter the shelf is moved to the height equal to the exit of the trimming unit so as to receive the next trimmed booklets, and during operation of the accumulating unit in the accumulation mode, the shelf of the accumulating unit is lowered from the height equal to the exit of the trimming unit by a distance corresponding to the thickness of the trimmed booklets at every placement of the booklets on the shelf until the number of the trimmed booklets accumulated on the shelf reaches the maximum number of the trimmed booklets that can be accommodated by the accumulating unit or a predetermined numerical value.

2. The three side trimmer according to claim 1, wherein the conveying mechanism has a chuck head gripping the trimmed booklets, a guide extending from the trimming unit to the shelf of the accumulating unit, the chuck head being slidably mounted on the guide, and a chuck head drive mechanism reciprocating the chuck head along the guide, wherein whenever the trimming operation is completed, the chuck head moves from the trimming unit to the accumulating unit while gripping the trimmed booklets, and releases the trimmed booklets at a position above the shelf so as to place the trimmed booklets on the shelf, thereafter moves toward the trimming unit to grip the next trimmed booklets.

3. The three side trimmer according to claim 2, wherein a photoelectric sensor is arranged at the exit of the trimming unit to detect the trimmed booklets placed on the shelf of the accumulating unit, the photoelectric sensor being in an ON-state when a light beam horizontally irradiated from the photoelectric sensor is intercepted by the trimmed booklets, and being in an OFF-state when the light beam is not intercepted, wherein the shelf starts lowering when the chuck head releases the trimmed booklets, and stops when the photoelectric sensor switches into the OFF-state, so that the shelf lowers by the distance corresponding to the thickness of the trimmed booklets at every placement of the trimmed booklets on the shelf.

4. The three side trimmer according to claim 1, wherein a proximity sensor is arranged at one of the discharge unit or the trimming unit and the shelf of the accumulating unit, and a plate to be detected by the proximity sensor is arranged at the other of the discharge unit or the trimming unit and the shelf, the proximity sensor detecting the plate when the shelf reaches the height of the entrance of the discharge unit, wherein during operation of the accumulating unit in the delivery mode, whenever the shelf having the predetermined number of the trimmed booklets thereon is raised or lowered and the plate is detected by the proximity sensor, the shelf is stopped in a manner such that the conveyor belt or the drive roller conveyor on the shelf supplies the predetermined number of the trimmed booklets to the discharge unit.

5. The three side trimmer according to claim 1, wherein the conveyor belt or the drive roller conveyor on the shelf repeats forward and backward motions alternately by a certain distance at every accumulation of a certain number of the trimmed booklets on the shelf until the predetermined number of the trimmed booklets are accumulated on the shelf, whereby the trimmed booklets are placed at positions alternately shifted on the shelf.

6. The three side trimmer according to claim 1, wherein the height of the entrance of the discharge unit can be changed.

7. The three side trimmer according to claim 1, wherein the discharge unit is a conveyor belt or a drive roller conveyor or a free roller conveyor.

* * * * *